United States Patent [19]

Cade

[11] 4,295,129

[45] Oct. 13, 1981

[54] SYSTEM CONDITION INDICATOR

[75] Inventor: Phillip J. Cade, Winchester, Mass.

[73] Assignee: Electronics Corporation of America, Cambridge, Mass.

[21] Appl. No.: 36,547

[22] Filed: May 7, 1979

[51] Int. Cl.[3] ..... G08B 23/00

[52] U.S. Cl. ..... 340/520; 340/501; 340/521; 110/193; 126/388; 236/94

[58] Field of Search ..... 340/520, 516, 517, 519, 340/521, 527, 583, 587, 619, 635, 500, 501; 236/21 R, 94, 99 A, 99 C, DIG. 2, DIG. 15; 110/185, 191, 193; 126/388; 11/11

[56] References Cited

U.S. PATENT DOCUMENTS

| | | | |
|---|---|---|---|
| 2,900,628 | 8/1959 | Fegely | 340/644 |
| 3,179,930 | 4/1965 | Pell | 340/654 |
| 3,237,183 | 2/1966 | Eagan | 340/523 |
| 3,264,613 | 8/1966 | Stolle | 340/147 LP |
| 3,381,286 | 4/1968 | Walsh | 340/520 |
| 3,419,857 | 12/1968 | Martin | 340/503 |
| 3,440,524 | 4/1969 | Jarld | 340/523 |
| 3,474,443 | 10/1969 | Lightner | 340/502 |
| 3,480,938 | 11/1969 | Martin | 340/502 |
| 3,484,770 | 12/1969 | Cheeseman | 340/523 |
| 3,527,987 | 9/1970 | Havlicek | 340/517 |
| 3,548,399 | 12/1970 | Monigal | 340/520 |
| 3,611,364 | 10/1971 | Jones | 340/520 |
| 3,729,734 | 4/1973 | Kipling | 340/520 |
| 3,838,411 | 9/1974 | Rapistan et al. | 340/517 |
| 3,872,473 | 3/1975 | Melgaard et al. | 340/520 |
| 3,960,011 | 6/1976 | Renz et al. | 340/520 |
| 3,967,281 | 6/1976 | Dageford | 340/520 |

FOREIGN PATENT DOCUMENTS

| | | | |
|---|---|---|---|
| 821060 | of 0000 | Belgium | 340/520 |
| 2046384 | of 0000 | Fed. Rep. of Germany | 340/520 |

OTHER PUBLICATIONS

Electronics Corporation of America, "System Indicator," Jan., 1979; Bulletin C-600.

Electronics Corporation of America, "Fireye Division", Oct. 6, 1977.

I.B.M. Technical Disclosure Bulletin, vol. 15, No. 10, pp. 3203-3204.

*Primary Examiner*—John W. Caldwell, Sr.
*Assistant Examiner*—Donnie L. Crosland
*Attorney, Agent, or Firm*—Charles E. Pfund

[57] ABSTRACT

A system condition indicator for monitoring a number of interlock switches and fuel valves to detect what event first occurs to shut down a burner control system. The monitoring circuitry is periodically strobed once each cycle of the power line signal and is only responsive to an abnormal interlock switch or fuel valve during the strobe time. The present invention does not respond to an abnormal condition for a predetermined time after burner operation is initiated, to allow the system parameters to go to their operational values. The present invention includes circuitry for monitoring the pilot fuel flow and the main fuel flow and for providing an indication if either flow is abnormally terminated to shut down the furnace system. When the furnace system is shut down in response to an abnormal condition, an indication is provided of the first interlock switch or fuel valve to open, allowing a determination to be made of what caused the furnace failure, either during start-up or during normal operation.

15 Claims, 3 Drawing Figures

SYSTEM CONDITION INDICATOR

FIELD OF THE INVENTION

The present invention is related to burner control systems in which a number of conditions in a furnace or burner are supervised, and in particular to circuits for indicating which of a number of sensors in a burner control system was the first to indicate an abnormal condition.

BACKGROUND OF THE INVENTION

Many burner control systems, particularly those that operate automatically or unattended, are protected by a number of different interlock switches which monitor particular conditions in the burner system and which shut down the system if a dangerous condition is detected by one or more of the switches. Frequently, during the shutdown procedure, one or more of the monitored conditions will change such that the associated interlock switch also opens. It is also not uncommon for an interlock switch to open momentarily and then reclose. If the cause of the failure is intermitent or only appears during operation, it may be very difficult to determine what caused the shutdown or how to correct the condition.

Systems are known which monitor a number of interlock switches and detect which of the switches first opens to shut down a system. One example of such a system is the type 53SE1 System Indicator, manufactured by the Electronics Corporation of America.

In starting up a burner control system, a number of operations occur in sequence during the ignition of a pilot flame and a main flame. During the start-up sequence, the burner control system may shut down the furnace in response to failures which are not normally monitored by means of interlock switches during the main burner operation. Frequently, during the shutdown of a furnace during the start-up procedure, an interlock switch will open. If the interlock switches are monitored by a typical, prior art circuit, this circuit will indicate that that interlock switch was first activated. This may provide an erroneous indication of the source of the failure, since the failure may actually have occurred in a part of the burner not monitored by interlock switches. Thus, such a system may, in fact, mislead a person who is attempting to determine the cause of the furnace failure.

SUMMARY OF THE INVENTION

The present invention includes a system condition indicator for monitoring a number of interlock switches and fuel valves to detect which of the switches first opens to shut down a burner control system. The monitoring circuitry is periodically strobed once each cycle of the power line signal and is only responsive to an abnormal interlock switch or fuel valve condition during the strobe time. This reduces the susceptibility of the system to noise transients on the power line. Circuitry is provided which inhibits the present invention from responding to an abnormal condition for a predetermined time after burner operation is initiated, to allow the system parameters to go to their operational values. The present invention includes circuitry for monitoring the pilot fuel flow and the main fuel flow and for providing an indication if either flow is abnormally terminated to shut down the furnace system. When the furnace system is shut down in response to an abnormal condition, an indication is provided of the first interlock switch or fuel valve to open, allowing an operator to determine what caused the furnace failure, either during start-up or during normal operation.

DESCRIPTIONS OF THE DRAWINGS

These and other advantages of the present invention will become more clear upon reading the following description of the preferred embodiment in conjunction with the accompanying figures, of which:

DESCRIPTION OF THE PREFERRED EMBODIMENT

Figure 1:
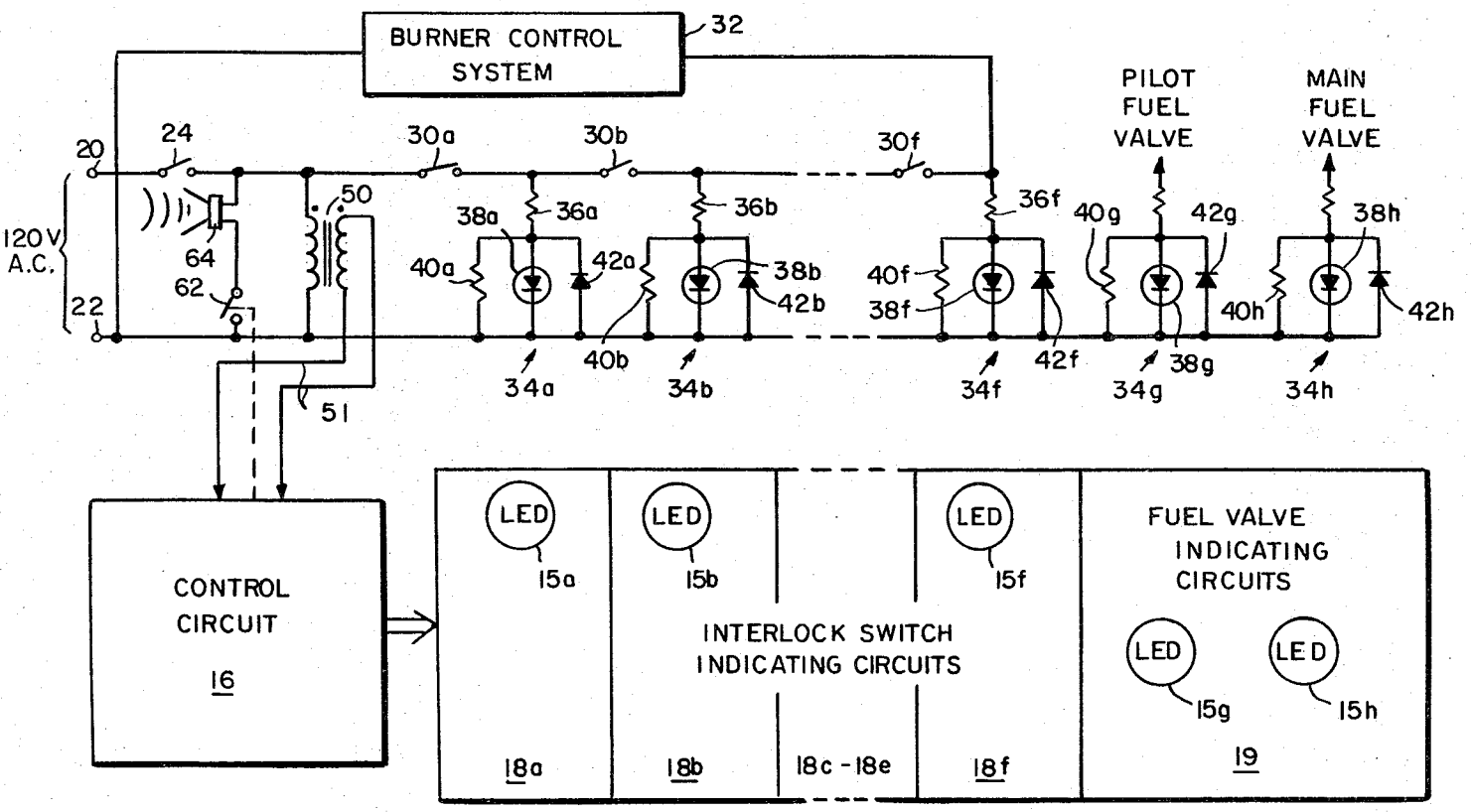
FIG. 1 shows the present invention in block diagram form and the relationship between the invention and the interlock switches.

Referring to FIG. 1, there is shown one embodiment of the present invention for monitoring a plurality of interlock switches and in addition for monitoring the flow of fuel to a pilot burner and a main burner. A power line signal, typically 120 volts AC, is applied to hot and common terminals 20 and 22. One terminal of an operating control switch 24 is connected to hot terminal 20, and in response to the closing of operating control 24, power is present between the other terminal of switch 24 and common terminal 22. This power is applied to the burner and burner control system, and is also applied to the system condition indicator circuitry described below.

In a furnace installation, a number of interlock switches are typically found monitoring critical parameters of the burner. Such parameters might include air flow, fuel pressure, oil pressure, and other conditions. Typically, these interlock switches are closed to indicate a normal or safe condition. The interlock switches are connected in series with the power line; and if any switch opens, indicating an unsafe condition, the power line voltage to the burner control system is interrupted.

The example shown in FIG. 1 includes six interlock switches, 30*a* through 30*f*, which are connected in series with the burner control system electronics 32 between operating control 24 and common terminal 22. Five monitor circuits 34*a*–34*e* are connected between the junction of adjacent interlock switches 30 and common terminal 22, and a final monitor circuit 34*f* is connected following the last interlock switch 30*f*. Each of these monitor circuits 34 is associated with a respective one of the interlock switches, as indicated by the letter designation and provides an output signal representative of whether line voltage is present at the associated switch terminal.

Each monitor circuit 34 includes a current-limiting resistor 36 in series with the light source of an optical coupler 38. Although optical couplers are used in the preferred embodiment described herein, other isolation devices may equally well be used, such as relays, etc. In the present embodiment, the optical couplers used have an LED light source. In parallel with the LED 38 of each indicator network is a resistor 40 and a diode 42 connected in the opposite polarity to the LED.

If all interlock switches 30 are closed and operating control 24 is closed, line voltage is applied across each monitor circuit 34, and the associated optical coupler LED is illuminated in response. If, during the operation of the system, an interlock switch 30 opens, power is removed from the burner control system. Power is also removed from each of the monitor circuits 34 which follow the open interlock switch, while the monitor circuits which precede the open lockout switch remain illuminated. Thus, the first interlock switch to open may be determined by detecting which two adjacent optical couplers include an illuminated LED and an unilluminated LED.

Two additional monitor circuits 34*g* and 34*f* are connected in series across the pilot fuel valve power and the main fuel valve power. During the periods that the pilot and main valves are open, the associated optical coupler LED's 38 are illuminated. Especially during start-up of the furnace system, the burner control system may shut down the furnace in response to conditions which are not usually monitored by interlock switches. One of the first actions taken during such a shutdown is the termination of fuel to the pilot and/or main burners. The circuitry described below monitors the power applied to the pilot and main valves and provides an indication if fuel to either valve is terminated abnormally. This indication allows someone trouble-shooting the system to determine that the shutdown was caused by the burner control system closing a fuel valve, and whether the furnace was shutdown during start-up or normal operation.

Associated with each monitor circuit 34 is a corresponding indicating circuit eighteen or 19. The optical coupler LED's 38 control the optical coupler receivers 162 which are located in the associated indicating circuits 18 and 19 and shown in FIG. 3. In response to the opening of an interlock switch or the termination of fuel flow, the associated indicating circuit actuates an output indicator 15, such as an LED, in the associated indicating circuit which remains lighted to provide an indication of the cause of the furnace shutdown.

The indicating circuits 18 and 19 are responsive to several signals produced by control circuit 16. A strobe signal is periodically applied to the indicating circuits; and the indicating circuits are only responsive to an open interlock switch or fuel valve during the strobe interval. This results in lower susceptibility to power line transients. Control circuit 16 also senses when one of the indicating circuits has been activated, and in response control circuit 16 disables the remaining indicator circuits so that only the LED associated with the first interlock switch or fuel valve to open is illuminated.

While six interlock switches and associated monitor and indicating circuits are shown in the preferred embodiment described herein, a greater (or lesser) number of interlock switches may be monitored, by adding additional monitor and indicating circuits, as required. This will become apparent from the description below of the indicating circuit operation. The fuel valve indicating circuits 19 may be combined with any number of interlock switch indicating circuits, while still providing the same monitoring of the main and pilot fuel valves.

Figure 2:
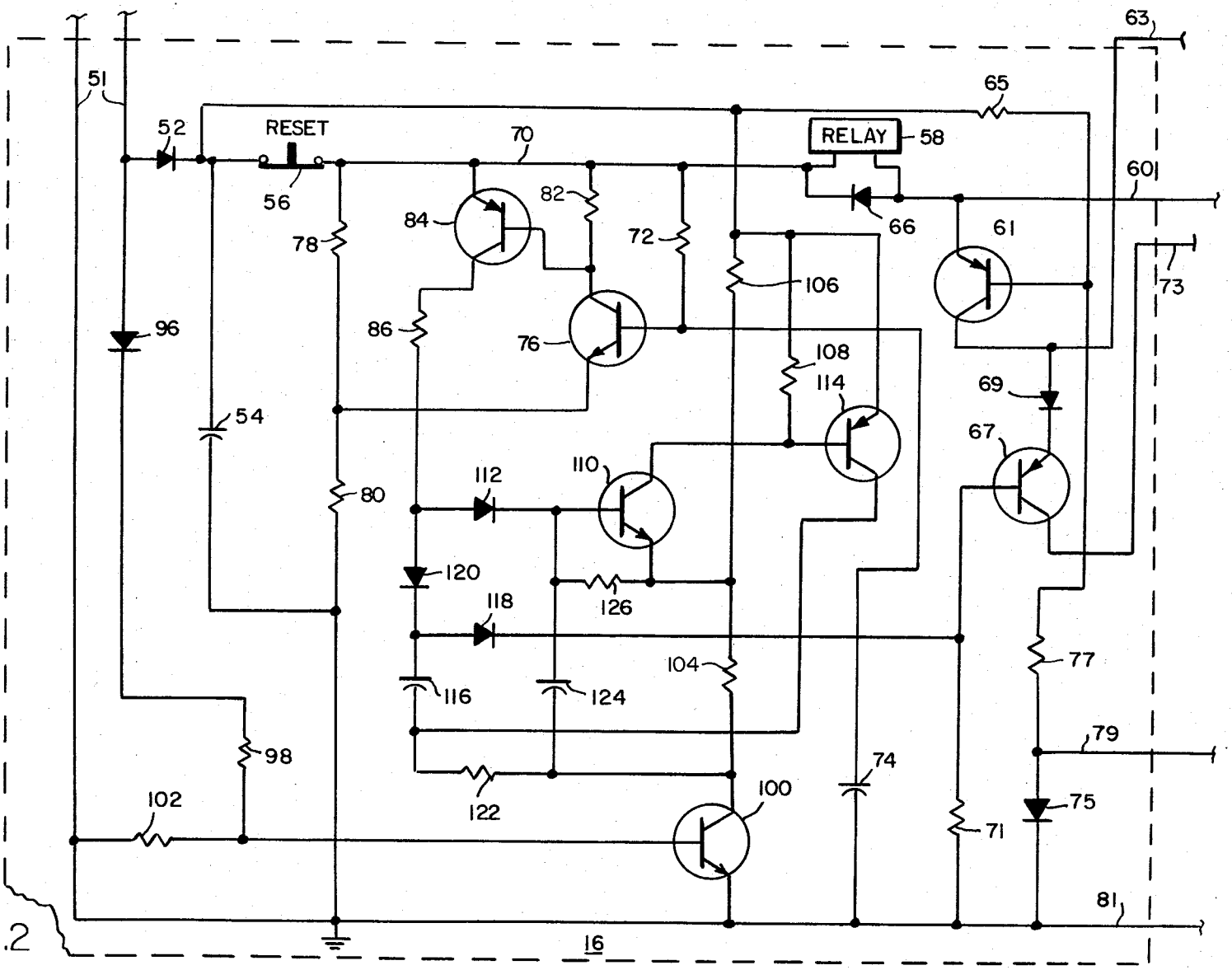
FIG. 2 is a circuit diagram of the control circuit shown in FIG. 1.

Power and other control signals necessary for the proper operation of the indicator circuits are provided by control circuit 16, which is shown in detail in FIG. 2. Connected across the power line and in series with operating control 24 is a step-down transformer 50 which provides low voltage AC power on lines 51 to control circuit 16. Connected in series across the secondary of transformer 50 are a diode 52 and a filter capacitor 54. DC power having a voltage V is present at the junction of diode 52 and capacitor 54 when operating control 24 is closed. A reset switch 56 is normally closed, and power flows through switch 56 and an alarm relay coil 58 to line 60. In response to the opening of an interlock switch, an indicating device, such as an LED 150, is connected between line 60 and ground. The LED is illuminated to provide an indication of which interlock switch first opened; and the current drawn by the LED actuates alarm relay 58. The contacts 62 of the relay 58 are connected in series with an alarm 64 between operating control 24 and the common terminal 22.

To reset the system after a burner shutdown has occurred, reset switch 56 interupts DC power to relay 58 and the associated circuitry, as described in detail below. A diode 66 is connected across the coil of relay 58 to provide a path for the current caused by the self-inductance of the relay coil 58 when reset switch 56 is opened. Alternatively, the system may be reset by removing power from terminals 20 and 22.

When operating control 24 is first closed, power is initially applied to a blower which provides air flow through the furnace. Typically the air flow is monitored by one of the interlock switches 30. A brief period of time is required after operating control 24 closes before the blower motor reaches full speed and the air flow through the furnace is sufficient to actuate the air flow interlock switch. Other interlocks may also require a momentary delay before reaching their normal positions. Unless the circuitry monitoring the interlock switches is disabled during this brief startup interval, the system condition indicator will be tripped by the initially open interlock switches and will not work properly.

Previous system condition indicators have disabled the indicator circuitry until after all the interlock switches have closed. Such systems have the disadvantage that no output indication is provided if the burner system is shut down by an interlock switch which never closes. In the present invention, the indicator circuits 18 are disabled for a period of time following the closure of operating control 24. After this delay, the indicating circuits are enabled and will indicate any interlock switches that are open at that time as will now be described.

When operating control 24 is closed, power is applied through reset switch 56 to line 70. Connected in series between line 70 and ground are a resistor 72 and a capacitor 74. A transistor 76 has its base terminal connected to the junction between resistor 72 and capacitor 74. Two equal-value resistors 78 and 80 are connected between line 70 and ground, and when operating control 24 is closed, a voltage V/2 equal to half the supply voltage is present at the junction of these resistors. The emitter of transistor 76 is connected to the junction of resistors 78 and 80, and transistor 76 is maintained in a non-conducting state as long as the base terminal of transistor 76 is lower than about half the supply voltage. When operating control 24 is closed, capacitor 74 starts to charge through resistor 72. The voltage on capacitor 74 is applied to the base terminal of transistor 76, and when this voltage exceeds V/2, transistor 76 turns on. Thus, the values of resistor 72 and capacitor 74 determine a delay time after the closing of operating control 24 during which time transistor 76 is in a non-conducting state.

The collector of transistor 76 is connected to the supply voltage on line 70 by a load resistor 82. The voltage at the collector of transistor 76 is applied to a transistor 84 whose emitter is connected to the supply voltage on line 70. When transistor 76 conducts, transistor 84 turns on and provides a current through a resistor 86. The indication circuits 18 are not enabled until transistor 84 turns on as will now be described.

A transistor 61 is connected between line 60 and a second line 63 to the indicating modules. The base terminal of transistor 61 is connected to the supply voltage through a current-limiting resistor 65. After the operating control 24 is closed and a DC voltage is applied to relay 58, transistor 61 is maintained in an on condition by the bias current through resistor 65 and applies a voltage substantially equal to the power supply voltage to line 63. The voltage on line 63 is used to power the optical coupler receivers 162, and power is applied to line 63 immediately after operating control 24 is closed.

The emitter of a second transistor 67 is connected via a diode 69 to line 63; and the base of this transistor is connected to ground through a resistor 71. The collector of transistor 67 is connected to a line 73 which is a strobe line 73 for the indicating circuits 18. As described in detail below, when a positive voltage is present on line 73, each of the indicating circuits is maintained in a condition which prevents it from changing state. Once during each cycle of the power line signal, the signal on line 73 is momentarily removed. During this interval, if one of the interlock switches 30 is open, the associated indicating circuit is activated to provide an indication of the interlock switch first opened.

During the start up period during which the interlock switches are allowed to close, transistor 67 is maintained on by bias current circuits thru resistor 71. This prevents the indicating circuits from being activated during the preliminary period to allow the interlock switches to close.

Control circuitry 16 provides strobe pulses on strobe line 73 to the indicating circuits 18 in the following manner. The AC signal from transformer 50 is half-wave rectified by a diode 96, and the half-wave rectified signal is applied via a current-limiting resistor 98 to the base terminal of a transistor 100. A second resistor 102 connected between the base terminal of transistor 100 and ground provides a path for leakage current. The half-wave rectified current signal applied to the base terminal of transistor 100 causes the transistor to conduct during alternate half cycles of the power line signal.

The collector of transistor 100 is connected to the DC supply voltage by two equal value resistors 104 and 106. A transistor 110 has its collector terminal connected to the DC supply voltage by a load resistor 108. The emitter of transistor 110 is connected to the power supply voltage via transistor 84, resistor 86, and a diode 112. Thus, after the initial delay following the closure of operating control 24, a positive signal is applied to the base of transistor 110.

Resistors 104 and 106 are of the same value. When transistor 100 is off, resistor 106 holds the emitter of transistor 110 at the power supply voltage and transistor 110 does not conduct. When transistor 100 turns on, the voltage at the emitter of transmitter 110 goes to a value approximately one-half the power supply voltage, and transistor 110 is turned on by current through resistor 86 and diode 112. The collector lead of transistor 110 is connected to the base terminal of a transistor 114. The emitter of transistor 114 is connected to the supply voltage, and when transistor 110 turns on, this also turns on transistors 114.

The collector of transistor 114 is connected to one terminal of a capacitor 116. The second terminal of capacitor 116 is connected to the base terminal of strobe signal transistor 67 by a diode 118. The second terminal of capacitor 116 is also connected to the supply voltage through transistor 84, resistor 86, and a diode 120.

When transistor 100 turns on, the emitter terminal of transistor 110 is biased half-way between ground and the supply voltage by equal-value resistors 104 and 106. Immediately after transistor 100 turns on, the base of transistor 110 is clamped to ground by capacitor 124. Capacitor 124 charges up through resistor 86 and diode 112 until the voltage at the base terminal of transistor 110 is sufficient to turn on transistor 110. When transistor 110 conducts, base current is provided for transistor 114 which also turns on. When transistor 114 turns on, its collector suddenly rises to the supply voltage; and this positive step signal is applied to the base of transistor 67 via capacitor 116 and diode 118, causing the base terminal of transistor 67 to go more positive and turning off transistor 67. Transistor 67 remains off until the voltage on capacitor 116 is discharged through diode 118 and resistor 71 sufficiently to turn transistor 67 back on. During the interval that transistor 67 is off, the strobe signal on line 73 is low allowing the indicating circuits to indicate if an interlock switch 30 has opened.

After one of the indicating circuits has detected that the associated interlock switch has opened, control circuitry 16 responds by disabling the remaining indicating modules so that only the first interlock switch to open is displaced. As described below, when an interlock switch opens, the associated indicating circuit connects an indicator, such as an LED, between indicator power line 60 and ground. This results in a voltage drop across the coil 58 of the alarm relay which causes line 60 to drop to within a couple of volts of ground. Since the base terminal of transistor 61 is maintained high by the supply voltage through resistor 65, the base-to-emitter junction of transistor 61 is reversed biased. This turns off transistor 61 removing power from optical coupler power line 63.

Figure 3:
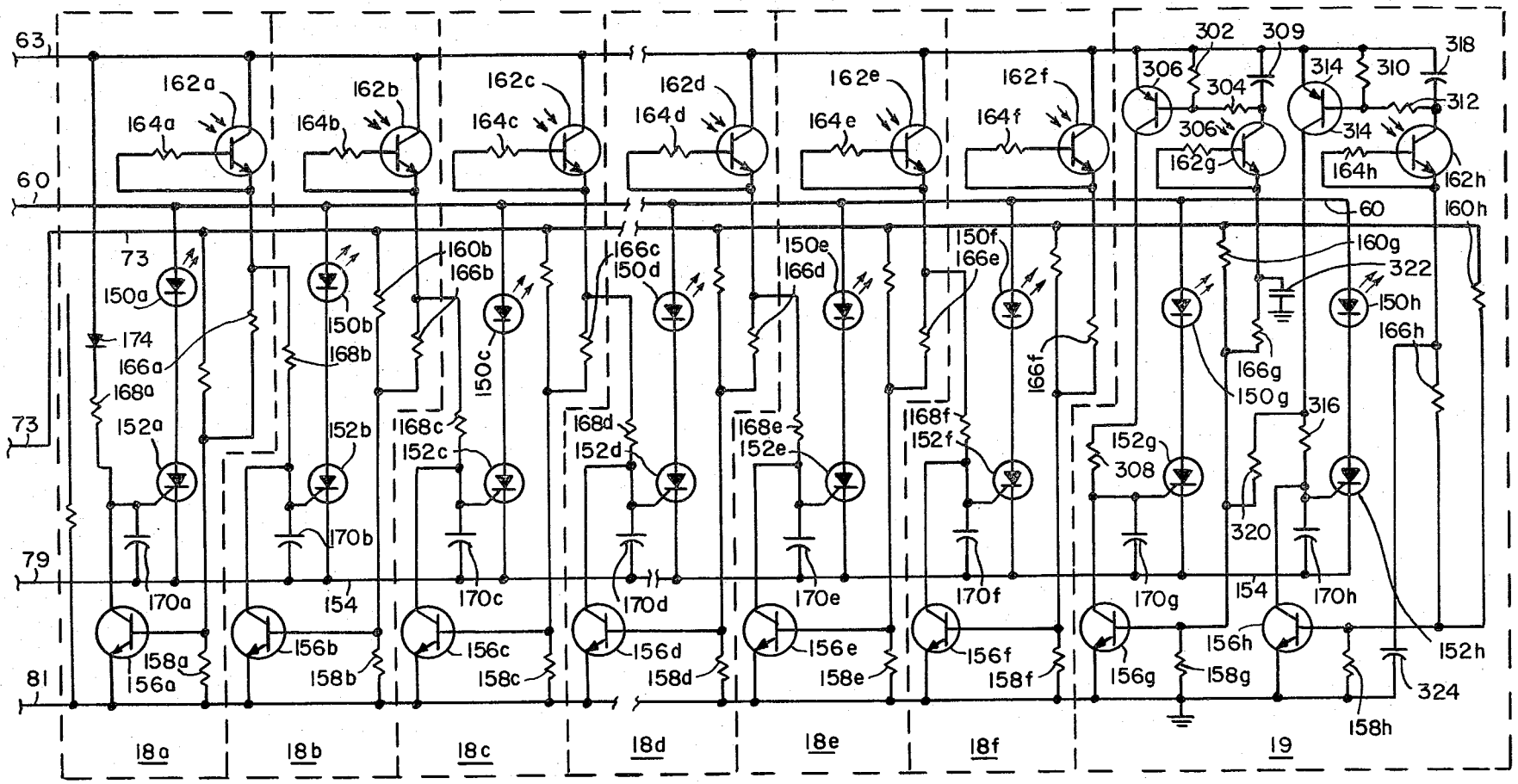
FIG. 3 is a circuit diagram of the indicating circuits.

Referring to FIG. 3, there is shown circuitry for the interlock switch indicating circuits 18 and the fuel valve indicating modules 19. The circuitry in each of the interlock switch indicating circuits 18 is the same and only the circuitry and operation of circuit **18*b* is described below. Connected to indicator power line 60 is an indicator LED 150. In series with LED 150 is a silicon controlled rectifier (SCR) 152*b*. The cathode of SCR 152*b* is connected to a bias line 79. Bias line 79 is maintained at a voltage of approximately 0.7 volts above ground by diode 75 in control circuitry 16**.

A transistor **156*b* is connected between the gate terminal of SCR 152*b* and ground. A voltage divider including equal-value resistors 158*b* and 160*b* is connected between strobe line 73 and ground. The base terminal of transistor 156*b* is connected to the junction of resistors 158*b* and 160*b***.

The light-responsive transistor **162*b* of the associated optical coupler 38*b* has its collector connected to line 63. The emitter terminal of transistor 162*b* is connected via a resistor 166*b* to the base terminal of transistor 156*b*. A second signal to the gate terminal of SCR 152*b* is provided by a resistor 168*b* connected between the gate terminal of SCR 152*b* and the emitter terminal of the optical coupler transistor 162***a* in the preceding indicating circuit 18*a*. A capacitor 170*b* connected between the gate terminal and cathode of SCR 152*b* prevents the SCR from being inadvertently turned on by transients.

Indicating module 18*b* operates in the following manner. To begin operation, SCR 152*b* is off, and the gate terminal of SCR 152 is clamped to ground by transistor 156*b*. During most of the time, strobe line 73 is high, and keeps transistor 156*b* turned on through resistor 160*b*. Periodically, strobe line 73 goes low when the indicating circuits 18 are strobed by control circuitry 16. If optical coupler transistor 162*b* is illuminated, the current through transistor 162*b* and resistor 166*b* maintains transistor 156*b* in an on condition during the strobe periods. If any of the preceding (i.e., to the left in the series connected string of switches 30, shown in FIG. 1) lockout switches 30 have opened, transistor 162*b* will not be illuminated and does not conduct. In this case, the gate terminal of transistor 156*b* is connected to ground through resistor 158*b*, and transistor 156*b* turns off.

When transistor 156*b* turns off, the voltage at the gate terminal of SCR 152*b* is controlled by the signal through resistor 168*b*. If the preceding optical coupler transistor 162*a* is illuminated, the current flowing through transistor 162*a* and resistor 168*b* turns on SCR 152*b*. However, if the preceding optical coupler transistor 162*a* is not illuminated, no current flows through resistor 168*b*, and the gate or SCR 152*b* is maintained low by capacitor 170*b*, thereby preventing conduction in SCR 152*b*. Thus, SCR 152*b* turns on during a strobe period when conduction in transistor 156*b* is not maintained by the high level on line 73 if, and only if, the associated optical coupler transistor 162*b* is illuminated and the preceding optical coupler transistor 162*a* is not illuminated.

When SCR 152*b* turns on, current flows from line 60 through LED 150*b* to line 154. As described above, bias line 154 is maintained at approximately 0.7 volts above ground by diode 75 in control circuitry 16. The voltage drop across SCR 152*b* is small, and the voltage drop across LED 150*b* is on the order of 1 volt. Thus, when SCR 152*b* turns on, line 60 is clamped to a voltage approximately 2 volts above ground. As described above, control circuitry 16 responds to this clamping of the voltage on line 60 by removing the voltage from optical coupler supply line 63 which prevents the remaining indicating circuits from being activated, should any other lockout switches 30 subsequently open.

Indicating module 19 includes LED's 150*g* and 150*h* which light up to show that the closing of either the pilot fuel valve or main fuel valve respectively was the first event to occur in a shutdown procedure. Similarly to indicating modules 18, module 19 includes two LED's 150*g* and 150*h* connected in series with associated SCR's 152*g* and 152*h* between power line 60 and bias line 154. Normally, the gate terminals of the SCR's 152*g* and 152*h* are clamped to ground by transistors 156*g* and 156*h*.

The collector of optical coupler transistor 162*g* is connected to line 63 by two resistors 302 and 304 connected in series. The junction of resistors 302 and 304 is applied to the base terminal of a transistor 306. The emitter of transistor 306 is connected to line 63 and the collector of transistor 306 is connected to the gate terminal of SCR 152*g* by a resistor 308.

To begin the furnace start up operation, the pilot fuel valve is closed and photo-transistor 162*g* is unilluminated and does not conduct. Transistor 306 is held in a non-conducting condition by resistor 302 and also does not conduct. Thus, when the signal on gating line 60 goes low, the gate of SCR 152*g* is maintained at a constant voltage by the charge on capacitor 170*g*. When the pilot fuel valve opens, photo-transistor 162*g* is illuminated from the LED of optical coupler 36*g* and conducts. The voltage drop across resistor 302 causes transistor 306 to also conduct. Although transistor 306 is conducting, the gate terminal of SCR 152*g* remains clamped to ground by transistor 156*g* as long as the pilot fuel valve is open and transistor 162*g* is illuminated.

Associated with main fuel valve LED 150*h* is circuitry similar to that described above for the pilot fuel valve. Optical coupler photo-transistor 162*h* has two resistors 310 and 312 connected between its collector and the power supply voltage. The junction of these resistors is connected to the base of transistor 314. The signal at the collector terminal of transistor 314 is applied via a resistor 316 to the gate terminal of SCR 152*h*. A capacitor 318 is connected between the collector terminal of transistor 162*h* and the power supply voltage.

When the pilot fuel valve closes, photo-transistor 162*g* is no longer illuminated and turns off. The charge on capacitor 309, however, maintains transistor 306 in a conducting state for a period following the closure of the pilot fuel valve. Although transistor 156*g* is no longer held on by transistor 162*g*, if the main fuel valve has opened before the pilot fuel valve is closed, transistor 314 is now on and the supply voltage at the collector of transistor 314 is applied via a resistor 320 to maintain transistor 156*g* in an on condition. Similarly, should the main fuel valve close before operating control 24 opens, SCR 152*h* is turned on to provide an indication thereof. If either LED 150*g* or 150*h* is turned on by the circuitry of indicating module 19, the voltage on line 60 is clamped to within a few volts of ground, as described above; and control circuitry 16 removes the optical coupler power supply voltage from line 63 to disable the remaining indicating modules.

It should be appreciated that the principals of the present invention can be applied to system condition indicator circuits different than that shown and described above. Examples of such circuits are given in U.S. patent application Ser. No. 406,318, filed Oct. 15, 1973, now abandoned, and assigned to the same assignee as the present application; and other circuits are known in the prior art.

There has been described a new and unique system condition indicator especially adapted for operation with a furnace or other type of burner. It should be appreciated that modifications to the preferred embodiment described herein will be apparent to those or ordinary skill in the art, and thus the description above of a preferred embodiment should not be construed as a limitation upon the present invention. Rather, the present invention should only be interpreted in accordance with the appended claims.

What is claimed is:

1. For use with a burner control system including a plurality of interlock switches, a main fuel valve, and a pilot fuel valve, a system condition indicator comprising;

a plurality of interlock monitor means, equal in number to the number of interlock switches and each associated with and connected to respective ones of the plurality of interlock switches, for determining the absence of an AC power line signal at a terminal of the associated interlock switch and for providing an output signal representative thereof;

main monitor means associated with and connected to the main fuel valve for providing an output signal representative of the open or closed state of the main fuel valve;

pilot monitor means associated with and connected to the pilot fuel valve for providing an output signal representative of the open or closed state of the pilot fuel valve; and detection means responsive only to the interlock monitor means output signals, the main monitor means output signal, and the pilot monitor means output signal, for detecting an abnormal condition in the interlock switches and fuel valves and for providing an indication, in response to a detected abnormal condition, of which of said valves and interlock switches was first to go to an abnormal condition;

wherein abnormal conditions include an open interlock switch, the main fuel valve going from an open state to a closed state, and the pilot fuel valve going from an open state to a closed state before the main fuel valve goes to an open state.

2. The indicator of claim 1 wherein the burner control system further includes an operating control for applying power to the burner system, and wherein the system condition indicator further comprises:

means responsive to actuation of the operating control for providing a delay period of a predetermined time after said actuation; and means for preventing the detection means from detecting an abnormal condition during the delay period, after which delay period the detection means is operative to detect an abnormal condition.

3. The indicator of claim 2 further comprising control means for applying power to an indicator power line;

wherein the detection means includes a plurality of indicating devices equal in number to the number of monitor means, and each associated with a respective one of said valves and interlock switches, and means for connecting each indicating device to the indicator power line in response to an abnormal condition of the associated interlock switch or valve;

and wherein the control means further includes means for detecting current drawn by an indicating device connected to the indicator power line by the detection means, and for preventing, in response to such detection, the connection of any more of the indicating devices to the indicator power line.

4. The indicator of claim 3 wherein the connecting means includes a plurality of silicon-controlled rectifiers, each connected to a respective one of the indicating devices.

5. The indicator of claim 4 wherein each of the monitor means includes:

an optical isolator, including a light source and a photo-detector for providing an output signal in response to light from the light source; and means for connecting the light source to the interlock switch or valve associated with that monitor means.

6. The indicator of claim 5 wherein the control means includes:

means for applying power to the photo-detectors after said delay period; and means for removing power from the photo-detectors upon detection of current being drawn from the indicator power line.

7. The indicator of claim 5 wherein each photo-detector is connected to a respective one of the silicon-controlled rectifiers, and when illuminated by the associated light source and powered by the control means, maintains the connected silicon-controlled rectifier in a non-conducting state.

8. The indicator of claims 3 or 7 wherein the indicating devices include light-emitting diodes.

9. For use with a burner control system including a plurality of interlock switches and at least one fuel valve, a system condition indicator comprising:

a plurality of interlock monitor means, equal in number to the number of interlock switches and each associated with and connected to respective ones of the plurality of interlock switches, for determining the absence of an AC power line signal at a terminal of the associated interlock switch and for providing an output signal representative thereof;

valve monitor means associated with and connected to the fuel valve for providing a signal representative of the open or closed state of the fuel valve;

an indicator power line;

detection means, responsive only to the interlock monitor means output signals and the valve monitor means output signal, for detecting an abnormal condition in the interlock switches and fuel valve and for providing an indication, in response to a detected abnormal condition, of which of said interlock switches and fuel valve was first to go to an abnormal condition including:

a plurality of indicating devices equal in number to the number of monitor means, and each associated with a respective one of said valve and interlock switches; and means for connecting an indicating device to the indicator power line in response to an abnormal condition of the associated interlock switch or valve;

control means for detecting current drawn by an indicating device connected to the indicator power line by the detection means, and for preventing, in response to such detection, the connection of any other indicating device to the indicator power line;

and wherein abnormal conditions include an open interlock switch and the fuel valve going from an open state to a closed state.

10. The indicator of claim 9 wherein the burner control system includes an operating control for applying power to the burner system, and wherein the system condition indication further comprises:

means responsive to actuation of the operating control for providing a delay period of a predetermined time after said actuation; and means for preventing the detection means from detecting an abnormal condition during the delay period, after which delay period the detection means is operative to detect an abnormal condition.

11. The indicator of claim 10 wherein the connecting means includes a plurality of silicon-controlled rectifiers, each connected to a respective one of the indicating devices.

12. The indicator of claim 11 wherein each of the monitor means includes:

an optical isolator including a light source and a photo-detector for providing an output signal in response to light from the light source; and means for connecting the light source to the interlock switch or valve associated with that monitor means.

13. The indicator of claim 12 wherein the control means includes:

means for applying power to the photo-detectors in said monitor means after said delay period, and means for removing power from the photo-detectors upon detection of current being drawn from the indicator power line.

14. The indicator of claim 13 wherein each photo-detector is connected to a respective one of the silicon-controlled rectifiers, and when illuminated by the associated light source and powered by the control means, maintains the connected silicon-controlled rectifier in a non-conducting state.

15. The indicator of claim 14 wherein each of the indicating devices comprises a light-emitting diode.

* * * * *